US008998026B2

(12) United States Patent
Nakayama et al.

(10) Patent No.: US 8,998,026 B2
(45) Date of Patent: Apr. 7, 2015

(54) BOTTLE FORMED OF SYNTHETIC RESIN MATERIAL INTO CYLINDRICAL SHAPE WITH BOTTOM

(75) Inventors: Tadayori Nakayama, Tokyo (JP); Goro Kurihara, Tokyo (JP); Hiroaki Imai, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 14/131,595

(22) PCT Filed: Jul. 25, 2012

(86) PCT No.: PCT/JP2012/068822

§ 371 (c)(1),
(2), (4) Date: Jan. 8, 2014

(87) PCT Pub. No.: WO2013/015312

PCT Pub. Date: Jan. 31, 2013

(65) Prior Publication Data

US 2014/0124473 A1 May 8, 2014

(30) Foreign Application Priority Data

Jul. 26, 2011 (JP) ..... 2011-163103
Aug. 31, 2011 (JP) ..... 2011-188613

(51) Int. Cl.
*B65D 6/02* (2006.01)
*B65D 8/12* (2006.01)
(Continued)

(52) U.S. Cl.
CPC ..... *B65D 1/40* (2013.01); *B65D 1/0276* (2013.01)
USPC ..... 220/609; 220/624; 215/371; 215/376

(58) Field of Classification Search
USPC ..... 220/606, 608, 609, 623, 624, 635; 215/371, 372, 373, 376
See application file for complete search history.

(56) References Cited

U.S. PATENT DOCUMENTS 4,147,271 A * 4/1979 Yamaguchi ..... 220/606
4,465,199 A 8/1984 Aoki (Continued)

FOREIGN PATENT DOCUMENTS

EP 2623428 A1 8/2013
FR 2508004 A1 12/1982

(Continued)

OTHER PUBLICATIONS

Sep. 4, 2012 Search Report issued in International Patent Application No. PCT/JP2012/068822 (with translation).

(Continued)

*Primary Examiner* — Fenn Mathew
*Assistant Examiner* — Jennifer Castriotta
(74) *Attorney, Agent, or Firm* — Oliff PLC

(57) ABSTRACT

A synthetic resin bottle has a cylindrical shape with a bottom, and a bottom wall portion that includes a grounding portion located at an outer circumferential edge, a rising circumferential wall portion that is connected from an inner side to the grounding portion and extends upward, an annular movable wall portion protruding from an upper end of the rising circumferential wall portion toward the bottle radial inner side, and a recessed circumferential wall portion between the bottle radial inner side and the movable wall portion. The movable wall portion is free to rotate around a portion connected to the rising circumferential wall portion so as to move the recessed circumferential wall portion in an upward direction. The rising circumferential wall portion extends to be gradually inclined toward the bottle inner side, and an inclined angle thereof is equal to or less than 10° with respect to a bottle axis.

6 Claims, 8 Drawing Sheets

(51) Int. Cl.

| | |
|---|---|
| ***B65D 90/02*** | (2006.01) |
| ***B65D 1/40*** | (2006.01) |
| ***B65D 1/02*** | (2006.01) |

(56) References Cited

U.S. PATENT DOCUMENTS

| | | | | |
|---|---|---|---|---|
| 5,730,314 | A * | 3/1998 | Wiemann et al. | 220/609 |
| 6,176,382 | B1 * | 1/2001 | Bazlur Rashid | 215/373 |
| 7,451,886 | B2 * | 11/2008 | Lisch et al. | 215/373 |
| 2001/0002662 | A1 * | 6/2001 | Rashid | 215/373 |
| 2002/0074336 | A1 | 6/2002 | Silvers | |
| 2007/0084821 | A1 | 4/2007 | Bysick et al. | |
| 2010/0140278 | A1 | 6/2010 | Kelley et al. | |

FOREIGN PATENT DOCUMENTS

| | | | |
|---|---|---|---|
| JP | Y2 7-47293 | | 11/1995 |
| JP | A-2008-024314 | | 2/2008 |
| JP | A 2008-539141 | | 11/2008 |
| JP | A 2010-126184 | | 6/2010 |
| WO | WO 2006/118584 | A1 | 11/2006 |
| WO | WO 2012/057158 | A1 | 5/2012 |

OTHER PUBLICATIONS

Sep. 29, 2014 Office Action issued in Chinese Application No. 201280019689.1 (with English-language translation of Search Report only).

Feb. 3, 2015 Search Report issued in European Application No. 12817631.0.

* cited by examiner

BOTTLE FORMED OF SYNTHETIC RESIN MATERIAL INTO CYLINDRICAL SHAPE WITH BOTTOM

TECHNICAL FIELD

The present invention relates to a bottle.

Priority is claimed on Japanese Patent Application Nos. 2011-163103 and 2011-188613, filed on Jul. 26 and Aug. 31, 2011, the contents of which are incorporated herein by reference.

BACKGROUND ART

As a bottle that is formed of a synthetic resin material in a cylindrical shape with a bottom, the constitution of a bottle described in, for instance, Patent Document 1 below has been known from the past. In Patent Document 1, a constitution is disclosed in which a bottom wall portion of a bottom portion includes a grounding portion that is located at an outer circumferential edge, a rising circumferential wall portion that is connected from a bottle radial inner side to the grounding portion and extends upward, a movable wall portion that protrudes from an upper end of the rising circumferential wall portion toward the bottle radial inner side, and a recessed circumferential wall portion that extends upward from a bottle radial inner end of the movable wall portion, and a pressure reduced in the bottle is absorbed by rotating the bottom wall portion around a portion connected to the rising circumferential wall portion such that the movable wall portion moves the recessed circumferential wall portion in an upward direction.

CITATION LIST

Patent Document

[Patent Document 1]

Japanese Unexamined Patent Application, First Publication No. 2010-126184

SUMMARY OF INVENTION

Technical Problem

However, in the conventional bottle, during filling of contents or raising of internal pressure, the movable wall portion is rotated around the portion connected to the rising circumferential wall portion in a downward direction. As a result, a part of the movable wall portion reaches a position at which the grounding portion is disposed, or protrudes downward beyond the grounding portion. Thus, so-called bottom collapse that causes failure in grounding stability may easily occur.

In the present embodiment, the phrase "bottom collapse" refers to, as described above, a phenomenon that causes failure in grounding stability.

Further, in the conventional bottle, there is room for improvement in performance of absorbing the pressure reduced in the bottle.

A first object of the present invention is to provide a bottle capable of securing pressure reduction-absorbing performance while suppressing occurrence of bottom collapse.

A second object of the present invention is to provide a bottle capable of improving performance of absorbing a pressure reduced in the bottle.

Solution to Problem

According to a first aspect of the present invention, there is provided a bottle that is formed of a synthetic resin material in a cylindrical shape with a bottom, and a bottom wall portion of a bottom portion thereof includes a grounding portion, a rising circumferential wall portion, an annular movable wall portion, and a recessed circumferential wall portion. The grounding portion is located at an outer circumferential edge. The rising circumferential wall portion is connected from a bottle radial inner side to the grounding portion, and extends upward. The annular movable wall portion protrudes from an upper end of the rising circumferential wall portion toward the bottle radial inner side. The recessed circumferential wall portion is connected from the bottle radial inner side to the movable wall portion, and extends upward. The movable wall portion is disposed to be free to rotate around a portion connected to the rising circumferential wall portion so as to move the recessed circumferential wall portion in an upward direction. The rising circumferential wall portion extends so as to be gradually inclined toward the bottle radial inner side with the approach from the grounding portion to the portion connected to the movable wall portion, and an inclined angle thereof is equal to or less than 10° with respect to a bottle axis.

According to the bottle of the first aspect of the present invention, when a pressure is reduced in the bottle, the movable wall portion can rotate around the portion connected to the rising circumferential wall portion in an upward direction, and the recessed circumferential wall portion can be moved upward. For this reason, a volume of reduced-pressure absorption of the bottle can be increased to secure predetermined pressure reduction-absorbing performance.

Incidentally, the rising circumferential wall portion is inclined toward the bottle radial inner side with respect to the bottle axis with the approach to the portion connected to the movable wall portion. In this case, an inclined angle of the rising circumferential wall portion is equal to or less than 10°, and is formed in a state adjacent to an upright form. For this reason, the upper end side (the connecting portion side) of the rising circumferential wall portion can be inhibited from easily moving in a bottle radial direction. The movable wall portion is easily inhibited from rotating around the connecting portion in a downward direction during filling of contents. Thereby, it can be difficult to cause so-called bottom collapse.

Preferably, a height from the grounding portion to the connecting portion between the rising circumferential wall portion and the movable wall portion exceeds 7.5 mm.

In this case, since the connecting portion of the movable wall portion which serves as the rotational center is located at the height exceeding 7.5 mm from the grounding portion, it can be more difficult to cause the so-called bottom collapse during filling of contents. For this reason, it is possible to secure stable grounding performance, and to cope with, for example, high-temperature filling of the contents.

According to a second aspect of the present invention, the movable wall portion gradually extends downward with the approach from an outer end thereof, which is connected to the rising circumferential wall portion, to an inner end thereof, which is connected to the recessed circumferential wall portion. A height from the grounding portion to a lowermost end of the movable wall portion has a range between 35% and 65% of a height from the grounding portion to the outer end of the movable wall portion.

According to the bottle of the second aspect of the present invention, when a pressure is reduced in the bottle, the recessed circumferential wall portion moves upward by means of the rotation of the movable wall portion. Thereby, the reduced pressure can be absorbed. Particularly, after the movable wall portion gradually extends downward with the approach from the outer end thereof to the inner end thereof, the height from the grounding portion to the lowermost end of the movable wall portion is equal to or less than 65% of the height from the grounding portion to the outer end of the movable wall portion, and a great height difference between the outer end and the lowermost end of the movable wall portion is secured. As such, during filling of contents, the movable wall portion is easily rotated downward. For this reason, it is possible to increase an internal volume of the bottle and to raise a volume of reduced-pressure absorption just after the filling. Thereby, the pressure reduction-absorbing performance can be improved.

Further, the height from the grounding portion to the lowermost end is equal to or more than 35% of the height from the grounding portion to the outer end of the movable wall portion, and a distance between the lowermost lower end and the grounding portion is sufficiently secured. As such, when the movable wall portion is rotated downward along with the filling of the contents, the lowermost end does not easily swell beyond the grounding portion in a downward direction, and easily avoids contact with a grounding plane. Accordingly, even in the case of high-temperature filling, filling work can be reliably carried out while the swelling of the movable wall portion is suppressed.

Preferably, the height of the lowermost end of the movable wall portion from the grounding portion is equal to or more than 3 mm.

In this case, the lowermost end of the movable wall portion can be sufficiently separated from the grounding plane in an upward direction, or the swelling can be more reliably suppressed.

Advantageous Effects of Invention

According to the bottle, it is possible to secure the pressure reduction-absorbing performance while the occurrence of the bottom collapse is suppressed during filling of contents or raising of internal pressure.

According to the bottle, it is possible to improve the performance of absorbing the pressure reduced in the bottle.

DESCRIPTION OF EMBODIMENTS

Hereinafter, a bottle according to a first embodiment of the present invention will be described with reference to FIGS. 1 to 3.

(Constitution of Bottle)

Figure 1:
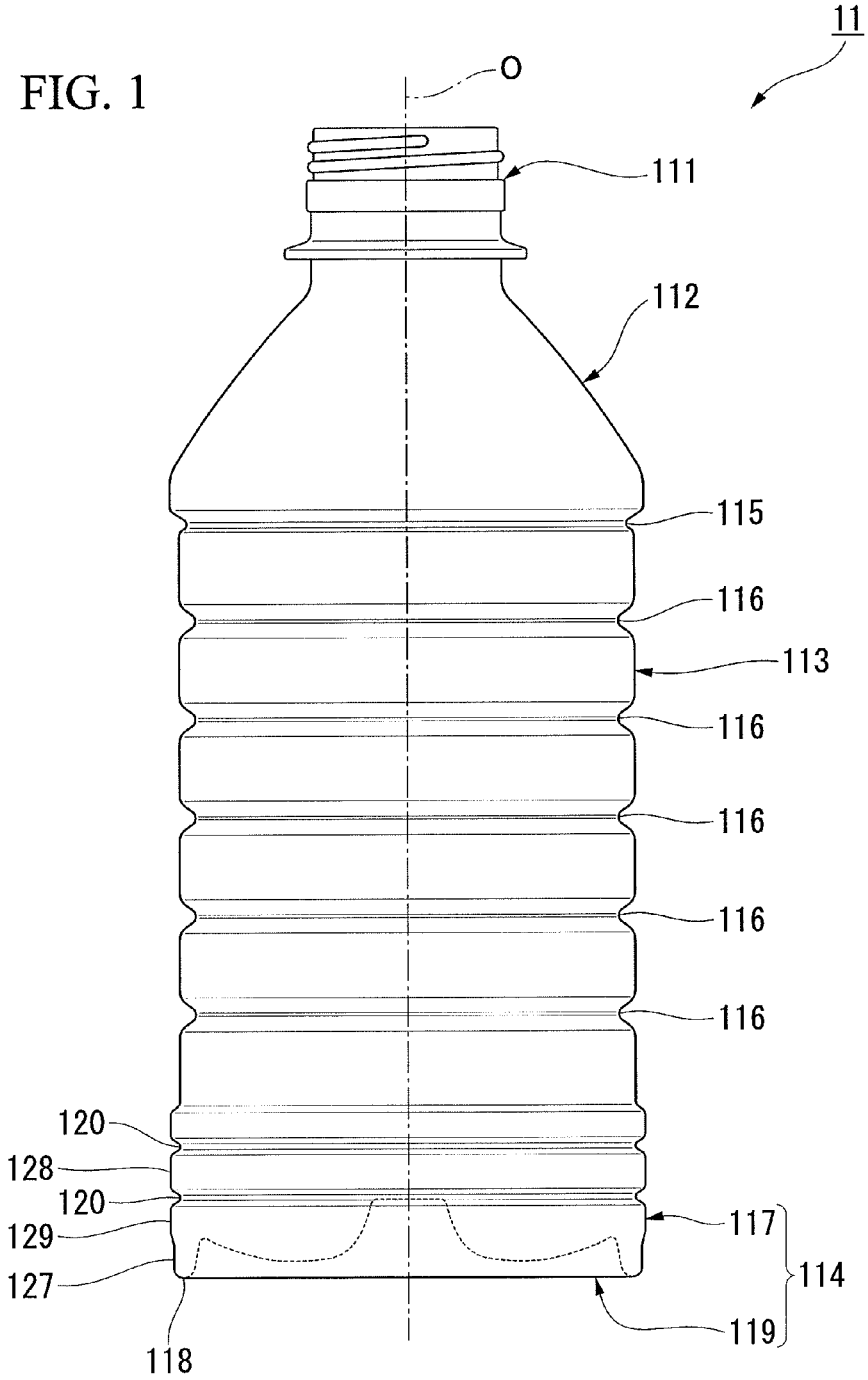
FIG. 1 is a front view of a bottle in a first embodiment of the present invention.

As shown in FIG. 1, the bottle 11 according to the first embodiment includes a mouth portion 111, a shoulder portion 112, a body portion 113, and a bottom portion 114. The mouth portion 111, the shoulder portion 112, the body portion 113, and the bottom portion 114 are continuously connected in this order with respective central axes thereof disposed on a common axis.

Hereinafter, the above-mentioned common axis is referred to as a bottle axis O. In the direction of the bottle axis O, a side of the mouth portion 111 is referred to as an upper side, and a side of the bottom portion 114 is referred to as a lower side. Further, a direction perpendicular to the bottle axis O is referred to as a bottle radial direction, and a direction going around the bottle axis O is referred to as a bottle circumferential direction.

For the bottle 11, a preform formed in a cylindrical shape with a bottom by injection molding is formed by blow molding, and is integrally formed of a synthetic resin material. Further, a cap (not shown) is screwed onto the mouth portion 111. Further, each of the mouth portion 111, the shoulder portion 112, the body portion 113, and the bottom portion 114 is formed in a circular shape when viewed from a cross portion perpendicular to the bottle axis O.

A first annular groove 115 is continuously formed between the shoulder portion 112 and the body portion 113 throughout the circumference of the body portion 113.

The body portion 113 is formed in a tubular shape, and has a smaller diameter than a lower end of the shoulder portion 112 and a heel portion 117 of the bottom portion 114 which will be described below. The body portion 113 is formed with a plurality of second annular grooves 116 that are spaced apart from one another in the direction of the bottle axis O. In the example of FIG. 1, five second annular grooves 116 are formed at regular intervals in the direction of the bottle axis O. Each of the second annular grooves 116 is a groove that is continuously formed throughout the circumference of the body portion 113.

The bottom portion 114 is formed in the shape of a cup having a heel portion 117 and a bottom wall portion 119. An upper opening section of the heel portion 117 is connected to a lower opening section of the body portion 113. The bottom wall portion 119 blocks a lower opening section of the heel portion 117, and an outer circumferential edge thereof serves as a grounding portion 118.

A lower heel edge portion 127 of the heel portion 117 which is connected from a bottle radial outer side to the grounding portion 118 is formed with a smaller diameter than an upper heel portion 128 that is connected from above to the lower heel edge portion 127.

The upper heel portion 128 is a maximum outer diameter portion of the bottle 11 along with the lower end of the shoulder portion 112.

Further, a connection part 129 between the lower heel edge portion 127 and the upper heel portion 128 is gradually reduced in diameter with the approach from top to bottom. Thereby, the lower heel edge portion 127 is formed with the smaller diameter than the upper heel portion 128. Further, a plurality of third annular grooves 120, each of which has approximately the same depth as, for instance, the first annular groove 115, are continuously formed in the upper heel portion 128 throughout the circumference of the upper heel portion 128. In the example of FIG. 1, two third annular grooves 120 are formed at intervals in the direction of the bottle axis O.

Figure 2:
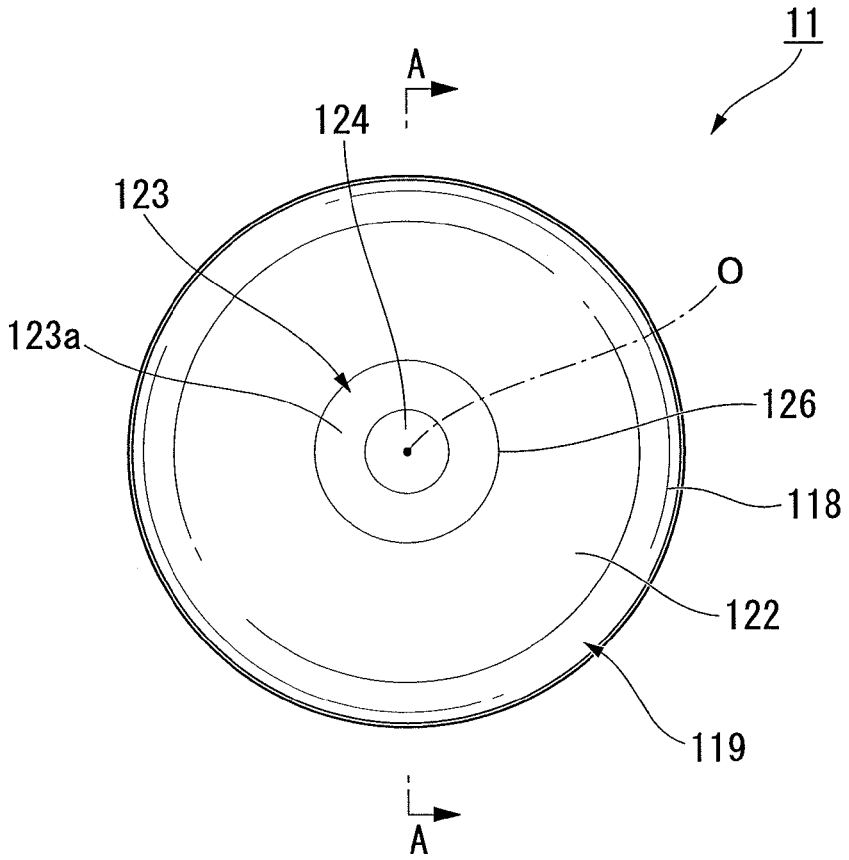
FIG. 2 is a bottom view of the bottle shown in FIG. 1.
Figure 3:
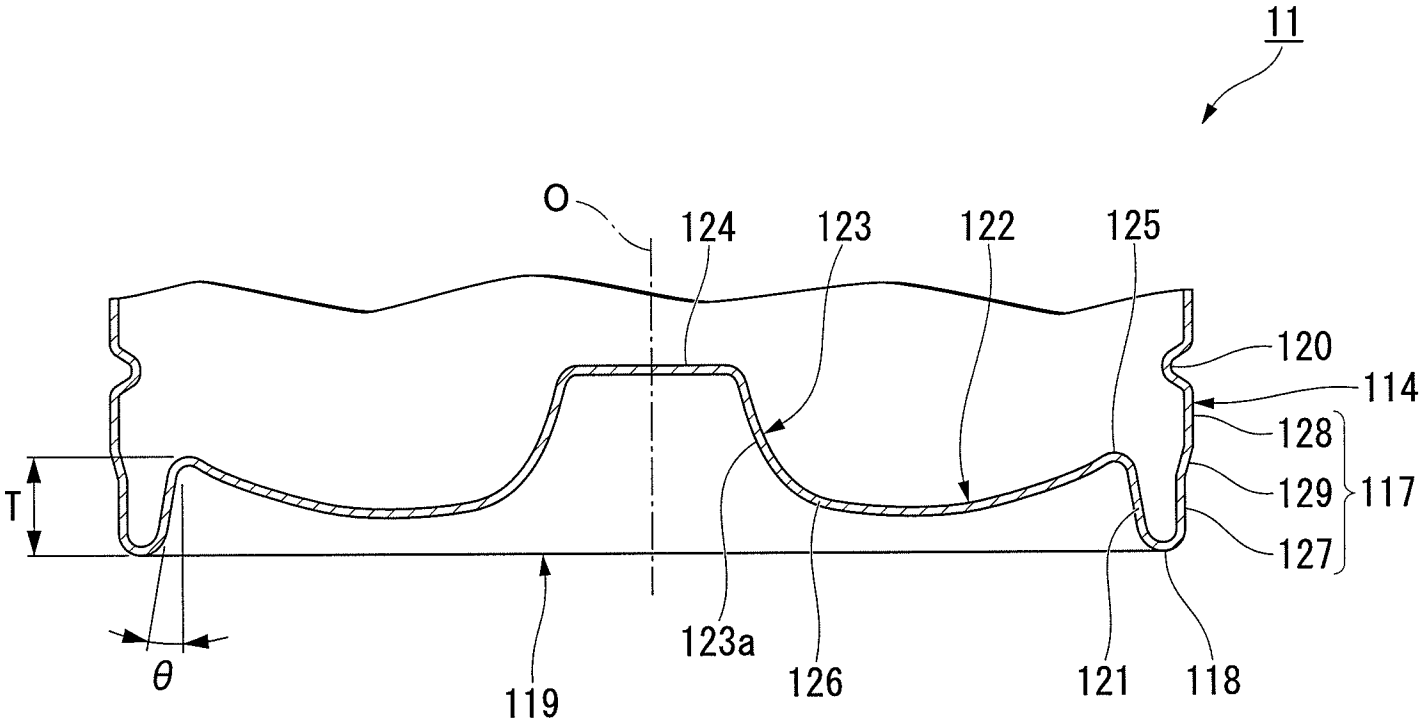
FIG. 3 is a cross-sectional view of the bottle taken along line A-A shown in FIG. 2.

As shown in FIGS. 2 and 3, the bottom wall portion 119 includes a rising circumferential wall portion 121, an annular movable wall portion 122, and a recessed circumferential wall portion 123. The rising circumferential wall portion 121 is connected from the bottle radial inner side to the grounding portion 118 and extends upward. The annular movable wall portion 122 protrudes from an upper end of the rising circumferential wall portion 121 toward the bottle radial inner side. The recessed circumferential wall portion 123 extends upward from a bottle radial inner end of the movable wall portion 122.

The movable wall portion 122 is formed in the shape of a curved surface that protrudes downward, and gradually extends downward with the approach from the bottle radial outer side to the bottle radial inner side. This movable wall portion 122 and the rising circumferential wall portion 121 are connected via a curved surface part 125 that protrudes upward. Then, to cause the recessed circumferential wall portion 123 to move upward, the movable wall portion 122 is formed to be free to rotate around the curved surface part (part connected to the rising circumferential wall portion 121) 125.

The rising circumferential wall portion 121 is gradually reduced in diameter with the approach from bottom to top. To be specific, the rising circumferential wall portion 121 extends so as to be gradually inclined toward the bottle radial inner side with the approach from the grounding portion 118 to the curved surface part 125 that is a part connected to the movable wall portion 122. In this case, an inclined angle θ is equal to or less than 10° with respect to the bottle axis O.

Further, in the first embodiment, a height T from the grounding portion 118 to the curved surface part 125 is a height exceeding 7.5 mm. For example, the height T is 7.7 mm.

The recessed circumferential wall portion 123 is disposed on the same axis as the bottle axis O, and is formed in a circular shape that gradually increases in diameter with the approach from top to bottom when viewed from a cross section. A disc-shaped top wall 124 disposed on the same axis as the bottle axis O is connected to an upper end of the recessed circumferential wall portion 123. A cylindrical shape with a top is formed by both of the recessed circumferential wall portion 123 and the top wall 124.

The recessed circumferential wall portion 123 is formed in the shape of a curved surface that protrudes toward the bottle radial inner side, and the upper end thereof has a curved wall 123*a* connected to an outer circumferential edge of the top wall 124. A lower end of the curved wall 123*a* is connected to the bottle radial inner end of the movable wall portion 122 via the curved surface part 126 that protrudes downward.

(Operation of Bottle)

When a pressure inside of the bottle 11 constituted in this way is reduced, the movable wall portion 122 is rotated around the curved surface part 125 of the bottom wall portion 119 in an upward direction. Thereby, the movable wall portion 122 moves so as to raise the recessed circumferential wall portion 123 in an upward direction. In other words, when the pressure is reduced, the bottom wall portion 119 of the bottle 11 is actively deformed, and thereby a change in internal pressure (reduced pressure) of the bottle 11 can be absorbed. Thereby, predetermined pressure reduction-absorbing performance can be secured.

However, in the bottle 11 of the first embodiment, the rising circumferential wall portion 121 is inclined to the bottle radial inner side with the approach to the curved surface part 125. The inclined angle θ of the rising circumferential wall portion 121 is equal to or less than 10 degrees with respect to the bottle axis O, and is formed in a state adjacent to an upright form. For this reason, the upper end side (side of the curved surface part 125) of the rising circumferential wall portion 121 can be inhibited from easily moving in a bottle radial direction. For this reason, during filling of contents or raising of internal pressure, the movable wall portion 122 is easily inhibited from rotating around the curved surface part 125 in a downward direction. In other words, the rising circumferential wall portion 121 is inhibited from being deformed and collapsing onto the bottle radial inner side. Thereby, it is possible to prevent so-called bottom collapse from easily occurring.

Furthermore, the curved surface part 125 serving as the rotational center of the movable wall portion 122 is disposed at a height that is located 7.7 mm above the grounding portion 118. For this reason, even when the movable wall portion 122 is somewhat rotated in a downward direction, it is easy to prevent occurrence of the bottom collapse. For this reason, it is possible to secure stable grounding performance, and to cope with, for example, high-temperature filling of the contents (e.g. from 80 to 100° C., and preferably from 85 to 93° C.).

Further, the bottle 11 of the first embodiment is suitable for a bottle in which contents are equal to or less than 1 liter and a grounding diameter is equal to or less than 85 mm. The example of FIG. 3 is a bottle in which the grounding diameter is 70 mm and the height T of the curved surface part 125 from the grounding portion 118 is 7.7 mm.

The technical scope of the present invention is not limited to the embodiment above, and various modifications are possible without departing from the spirit of the present invention.

For example, the inclined angle θ of the rising circumferential wall portion 121 is preferably equal to or less than 10 degrees. More preferably, the inclined angle θ of the rising circumferential wall portion 121 is equal to or less than 3 degrees.

Further, the movable wall portion 122 may be appropriately modified, for example, may protrude in parallel in the bottle radial direction or be inclined upward. In addition, the movable wall portion 122 may be appropriately modified, for example, may be formed in a planar shape or in a concave surface recessed upward.

Furthermore, the movable wall portion 122 may also be made up of an outer wall portion that gradually extends downward with the approach from the curved surface part 125 to the bottle radial inner side and an inner wall portion that connects the outer wall portion and the recessed circumferential wall portion and is formed in a concave surface recessed upward. By doing so, for instance, during filling of contents, it is more difficult for the inner wall portion of the movable wall portion 122 to move downward, and it is easy to effectively suppress the occurrence of the so-called bottom collapse.

Further, in the first embodiment, each of the shoulder portion 112, the body portion 113, and the bottom portion 114 has the circular shape when viewed from the cross section perpendicular to the bottle axis O. However, without being limited thereto, for example, the shape may be appropriately modified, for example, to a polygonal shape when viewed from the cross section.

In addition, the synthetic resin material forming the bottle 11 may be appropriately modified into, for instance, polyethylene terephthalate, polyethylene naphthalate, amorphous polyester, or a blend material thereof. Further, the bottle 11 is not limited to a single-layer structure, and may be a laminated structured having an intermediate layer. The intermediate layer includes, for instance, a layer formed of a resin material having a gas barrier characteristic, a layer formed of a recycled material, or a layer formed of a resin material having oxygen absorbability.

EXAMPLES

Next, a description will be made of examples in which changing of the upper end of the rising circumferential wall portion 121 in the bottle radial direction during filling of contents by a difference in the inclined angle θ of the rising circumferential wall portion 121 is tested (analyzed).

In the present test, four patterns shown below were tested as the examples. Further, four other patterns shown below were tested as comparative examples of the examples. In other words, a total of eight patterns were tested. Note that a height from a grounding plane to the top of the curved surface part 125 in the present test (when the bottle was empty) was 7.7 mm.

As the examples, four patterns of 1.5°, 3°, 4.5°, and 9° were employed as the inclined angle θ of the rising circumferential wall portion 121. In contrast, as the comparative examples, four patterns of 12°, 15°, 20°, and 30° were employed as the inclined angle θ of the rising circumferential wall portion 121.

Then, a predetermined internal pressure (0.5 kg/cm$^2$ (49 KPa)) was applied into the bottles 11 having the rising circumferential wall portions 121 of the total of eight patterns on the assumption that contents were filled in the bottle.

As a result, all bottles 11 were deformed in such a manner that the movable wall portion 122 was rotated around the curved surface part 125 in a downward direction and that the upper end of the rising circumferential wall portion 121 collapsed toward the bottle radial inner side. In other words, in all cases, the rising circumferential wall portion 121 was deformed so that the inclined angle θ was increased.

To be specific, in the four patterns of the examples, when the inclined angle θ was 1.5°, it was increased to 4.7° (variation of 3.2°). When the inclined angle θ was 3°, it was increased to 6.2° (variation of 3.2°). When the inclined angle θ was 4.5°, it was increased to 7.8° (variation of 3.3°). When the inclined angle θ was 9°, it was increased to 12.3° (variation of 3.3°).

In contrast, in the four patterns of the comparative examples, when the inclined angle θ was 12°, it was increased to 15.4° (variation of 3.4°). When the inclined angle θ was 15°, it was increased to 18.5° (variation of 3.5°). When the inclined angle θ was 20°, it was increased to 23.7° (variation of 3.7°). When the inclined angle θ was 30°, it was increased to 34° (variation 4°).

It could be confirmed from these results that the greater the inclined angle θ of the rising circumferential wall portion 121, the easier the upper end of the rising circumferential wall portion 121 moves so as to collapse onto the bottle radial inner side during filling of contents. In this respect, it could be confirmed that a part of the movable wall portion 122 easily approaches the grounding portion 118, i.e. that the bottom collapse easily occurs.

However, in any of the four patterns of the examples described above, it could be confirmed that the bottom collapse did not occur at all. In this respect, it could be actually confirmed that, as the inclined angle θ of the rising circumferential wall portion 121 was set to 10° or less with respect to the bottle axis O, the occurrence of the bottom collapse could be suppressed.

Next, a bottle according to a second embodiment of the present invention will be described with reference to FIGS. 4 to 8.

Figure 4:
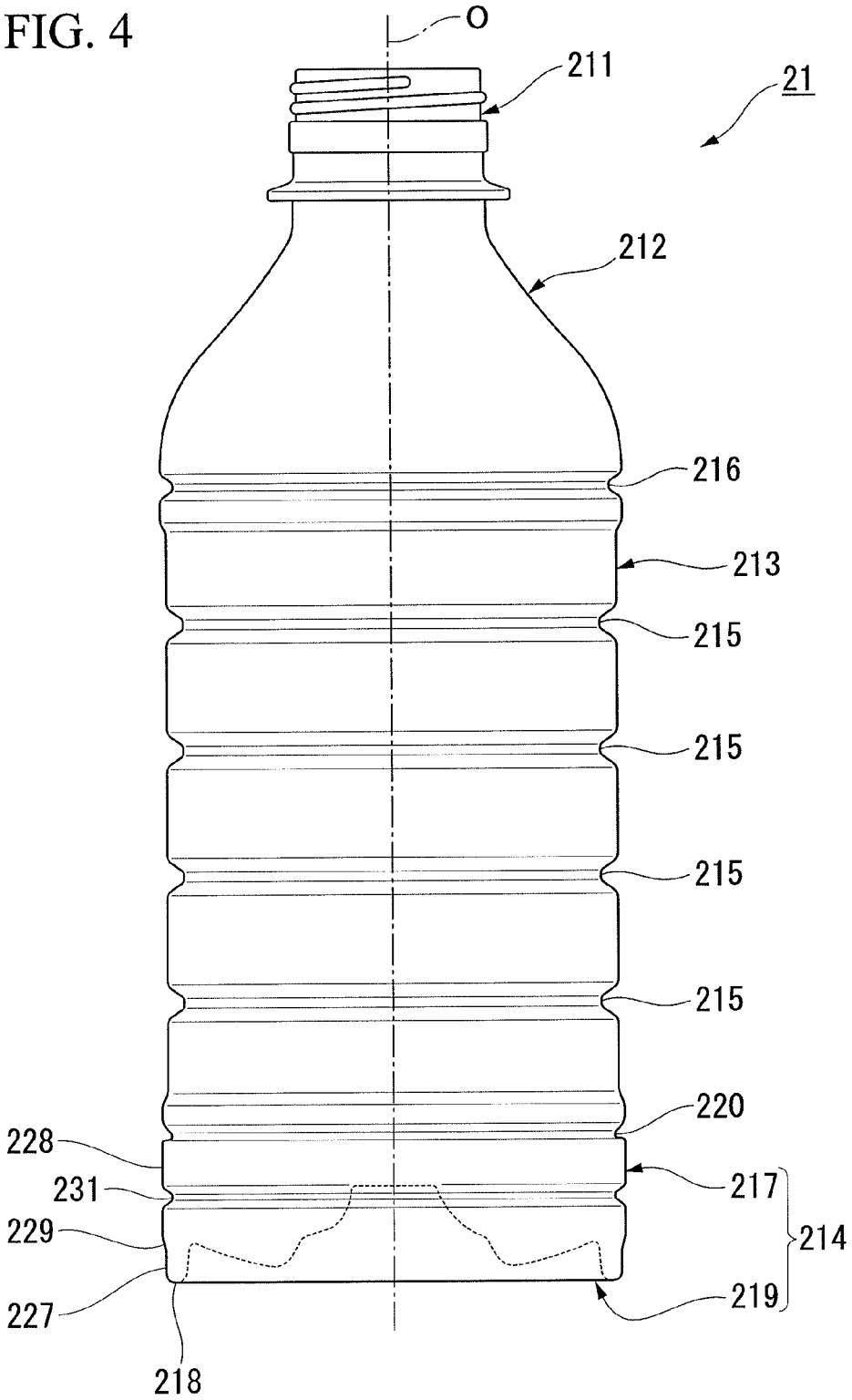
FIG. 4 is a front view of a bottle in a second embodiment of the present invention.
Figure 5:
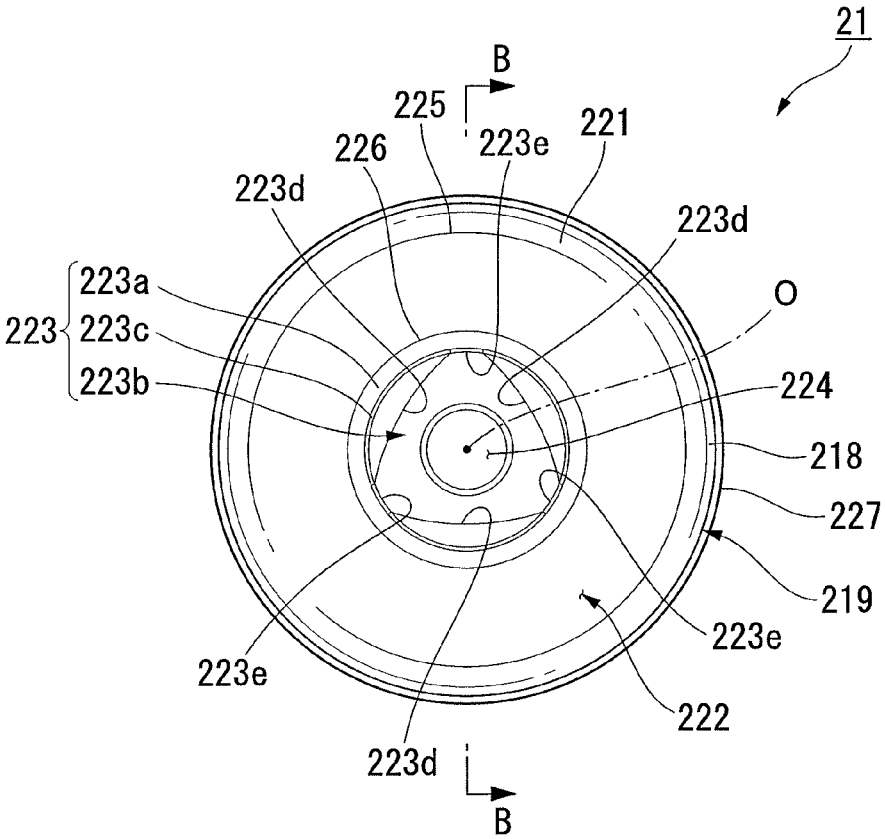
FIG. 5 is a bottom view of the bottle shown in FIG. 4.
Figure 6:
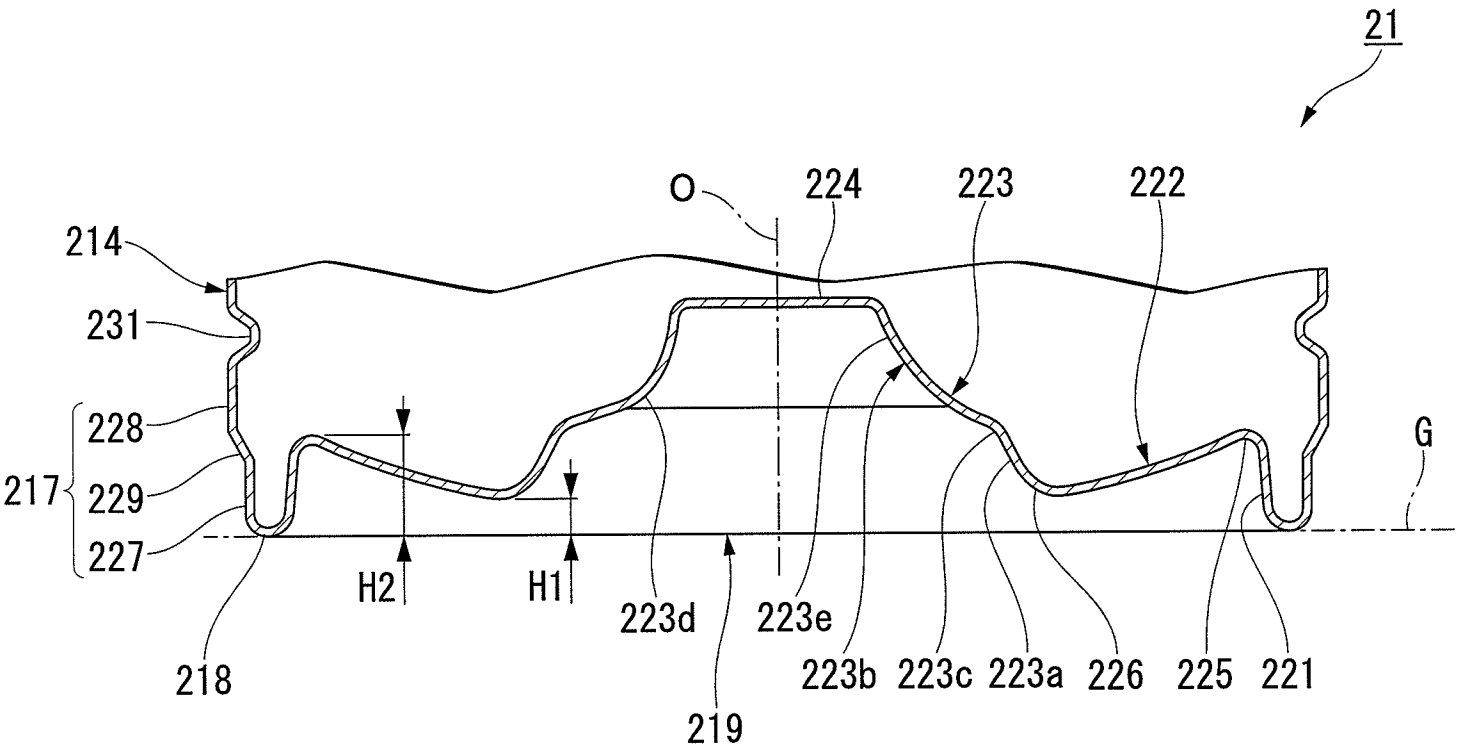
FIG. 6 is a cross-sectional view of the bottle taken along line B-B shown in FIG. 5.

As shown in FIGS. 4 to 6, a bottle 21 according to a second embodiment of the present invention includes a mouth portion 211, a shoulder portion 212, a body portion 213, and a bottom portion 214. The mouth portion 211, the shoulder portion 212, the body portion 213, and the bottom portion 214 are continuously connected in this order with respective central axes thereof disposed on a common axis.

Hereinafter, the above-mentioned common axis is referred to as a bottle axis O. In the direction of the bottle axis O, a side of the mouth portion 211 is referred to as an upper side, and a side of the bottom portion 214 is referred to as a lower side. Further, a direction perpendicular to the bottle axis O is referred to as a bottle radial direction, and a direction going around the bottle axis O is referred to as a bottle circumferential direction.

For the bottle 21, a preform formed in a cylindrical shape with a bottom by injection molding is formed by blow molding, and is integrally formed of a synthetic resin material. Further, a cap (not shown) is screwed onto the mouth portion 211. Further, each of the mouth portion 211, the shoulder portion 212, the body portion 213, and the bottom portion 214 is formed in a circular shape when viewed from a cross section perpendicular to the bottle axis O.

A first annular groove 216 is continuously formed in a connection part between the shoulder portion 212 and the body portion 213 throughout the circumference of the connection part.

The body portion 213 is formed in a tubular shape, and is formed between opposite ends thereof in the direction of the bottle axis O with a smaller diameter than the opposite ends. The body portion 213 is formed with a plurality of second annular grooves 215 that are spaced apart from one another in the direction of the bottle axis O. In the example of FIG. 4, four second annular grooves 215 are formed at regular intervals in the direction of the bottle axis O. Each of the second annular grooves 215 is a groove that is continuously formed throughout the circumference of the body portion 213.

A third annular groove 220 is continuously formed in a connection part between the body portion 213 and the bottom portion 214 throughout the circumference of the connection part.

The bottom portion 214 is formed in the shape of a cup that has a heel portion 217 whose upper opening section thereof is connected to a lower opening section of the body portion 213 and a bottom wall portion 219 which blocks a lower opening section of the heel portion 217 and whose outer circumferential edge serves as a grounding portion 218.

A lower heel edge portion 227 of the heel portion 217 which is connected from a bottle radial outer side to the grounding portion 218 is formed with a smaller diameter than an upper heel portion 228 that is connected from above to the lower heel edge portion 227.

The upper heel portion 228 is a maximum outer diameter portion of the bottle 21 along with the opposite ends of the body portion 213 in the direction of the bottle axis O.

Further, a connection part 229 between the lower heel edge portion 227 and the upper heel portion 228 is gradually reduced in diameter with the approach from top to bottom. Thereby, the lower heel edge portion 227 is formed with the smaller diameter than the upper heel portion 228. Further, a fourth annular groove 231, which has approximately the same depth as the third annular groove 220, is continuously formed in the upper heel portion 228 throughout the circumference of the upper heel portion 228.

As shown in FIG. 6, the bottom wall portion 219 includes a rising circumferential wall portion 221, an annular movable wall portion 222, and a recessed circumferential wall portion

223. The rising circumferential wall portion 221 is connected from the bottle radial inner side to the grounding portion 218 and extends upward. The annular movable wall portion 222 protrudes from an upper end of the rising circumferential wall portion 221 toward the bottle radial inner side. The recessed circumferential wall portion 223 is connected from the bottle radial inner side to the movable wall portion 222 and extends upward.

The grounding portion 218 is in line contact with a grounding plane G, for instance, in an annular shape. The rising circumferential wall portion 221 is gradually reduced in diameter with the approach from bottom to top.

The movable wall portion 222 is formed in the shape of a curved surface that protrudes downward, and gradually extends downward with the approach from an outer end thereof, which is connected to the rising circumferential wall portion 221, to an inner end thereof, which is connected to the recessed circumferential wall portion 223.

In the second embodiment, the movable wall portion 222 and the rising circumferential wall portion 221 are connected via a curved surface part 225 that protrudes upward, and the movable wall portion 222 and the recessed circumferential wall portion 223 are connected via a curved surface part 226 that protrudes downward. Further, the curved surface part 225 is the outer end of the movable wall portion 222, and the curved surface part 226 is the inner end, and simultaneously the lowermost end, of the movable wall portion 222.

To cause the recessed circumferential wall portion 223 to move upward, the movable wall portion 222 is formed to be free to rotate around the curved surface part 225 that is the outer end thereof.

Further, the curved surface part 225, which is the outer end of the movable wall portion 222, and the curved surface part 226, which is the inner end of the movable wall portion 222, are separated from the grounding plane G. In this case, a height H1 from the grounding portion 218 to the curved surface part 226, which is the inner end of the movable wall portion 222, is equal to or more than 3 mm. Further, the height H1 ranges from 35% to 65% of a height H2 from the grounding portion 218 to the curved surface part 225, which is the outer end of the movable wall portion 222.

The recessed circumferential wall portion 223 is disposed on the same axis as the bottle axis O, and is formed in a multistage shape while being gradually increased in diameter with the approach from top to bottom. A disc-shaped top wall 224 disposed on the same axis as the bottle axis O is connected to an upper end of the recessed circumferential wall portion 223. A cylindrical shape with a top is formed by both of the recessed circumferential wall portion 223 and the top wall 224.

The recessed circumferential wall portion 223 of the second embodiment includes a lower tube portion 223*a*, an upper tube portion 223*b*, and a transition portion 223*c*, and is formed in a two-stage tubular shape. The lower tube portion 223*a* is gradually reduced in diameter as it goes upward from the bottle radial inner end of the movable wall portion 222. The upper tube portion 223*b* has an upper end connected to an outer circumferential edge of the top wall 224, is gradually increased in diameter as it goes downward, and is formed in the shape of a curved surface that protrudes downward. The transition portion 223*c* connects the lower tube portion 223*a* and the upper tube portion 223*b*.

The lower tube portion 223*a* is formed in a circular shape when viewed from the cross section, and is connected to the movable wall portion 222 via the curved surface part 226. The upper tube portion 223*b* is formed with overhang portions 223*d* that overhang toward the bottle radial inner side. The overhang portions 223*d* are formed over almost the whole length of the direction of the bottle axis O excluding an upper end of the upper tube portion 223*b*. As shown in FIG. 5, the plurality of overhang portions 223*d* are continuously formed in the bottle circumferential direction.

In the example of FIG. 5, the overhang portions 223*d* adjacent to each other in the bottle circumferential direction are disposed at intervals in the bottle circumferential direction.

As the overhang portions 223*d* are formed, a shape of the upper tube portion 223*b* when viewed from the cross section is deformed from a polygonal shape to a circular shape with the approach from bottom to top. A shape of the upper end of the upper tube portion 223*b* when viewed from the cross section is formed in a circular shape. At a portion of the upper tube portion 223*b* whose shape becomes a polygonal shape when viewed from the cross section, the overhang portions 223*d* are polygonal sides. Intermediate portions 223*e* located between the overhang portions 223*d* adjacent to each other in the bottle circumferential direction are polygonal corners.

In the example of FIG. 5, the case in which the polygonal shape is an approximately regular triangle shape is taken by way of example. The shape of the of the upper tube portion 223*b* is not limited to this case.

When a pressure inside of the bottle 21 constituted in this way is reduced, the movable wall portion 222 is rotated around the curved surface part 225 in a upward direction. Thereby, the movable wall portion 222 moves so as to raise the recessed circumferential wall portion 223 in an upward direction. That is, the bottom wall portion 219 of the bottle 21 is positively deformed when the pressure is reduced, and thereby a change in the internal pressure (reduced pressure) of the bottle 21 can be absorbed.

Particularly, the movable wall portion 222 gradually extends downward with the approach from the curved surface part 225 that is the outer end thereof to the curved surface part 226 that is the inner end thereof. In addition, the height H1 from the grounding portion 218 to the curved surface part 226 that is the inner end of the movable wall portion 222 is equal to or less than 65% of the height H2 from the grounding portion 218 to the curved surface part 225 that is the outer end of the movable wall portion 222, and a great difference in height is secured. As such, during filling of contents, the movable wall portion 222 is easily rotated in a downward direction. For this reason, an internal volume of the bottle 21 is increased, and an amount of reduced-pressure absorption just after the filling can be increased. Thereby, the pressure reduction-absorbing performance can be improved.

Furthermore, the height H1 is equal to or more than 35% of the height H2, and a distance between the curved surface part 226, which is the inner end of the movable wall portion 222, and the grounding portion 218 is sufficiently secured. For this reason, when the movable wall portion 222 is rotated downward along with the filling of the contents, the curved surface part 226 does not easily swell beyond the grounding portion 218 in a downward direction, and easily avoids contact with the grounding plane G. Accordingly, even in the case of high-temperature filling, filling work can be reliably carried out while the swelling of the curved surface part 226 is suppressed.

Further, since the curved surface part 226 that is the inner end of the movable wall portion 222 is separated upward from the grounding portion 218 by 3 mm or more, it is possible to sufficiently separate the curved surface part 226 from the grounding plane G in an upward direction. Thereby, the swelling can be more reliably suppressed.

In the second embodiment, the case in which the curved surface part 226 that is the inner end of the movable wall portion 222 is the lowermost end of the movable wall portion 222 is given as an example. However, a case in which an approximately middle portion of the bottle radial direction becomes the lowermost end depending on the shape of the movable wall portion 222 is also considered. In this case, a height up to the lowermost end becomes the height H1.

Further, the bottle 21 of the second embodiment is suitable for a bottle that is used when contents are filled to a volume of 1 liter or less in a grounding diameter of 85 mm or less at 80° C. or more (in detail, within a temperature range from 80° C. to 95° C., and in greater detail at a filling temperature of about 87° C.).

The technical scope of the present invention is not limited to the embodiments above, and various modifications are made possible without departing from the spirit of the present invention.

Figure 7:
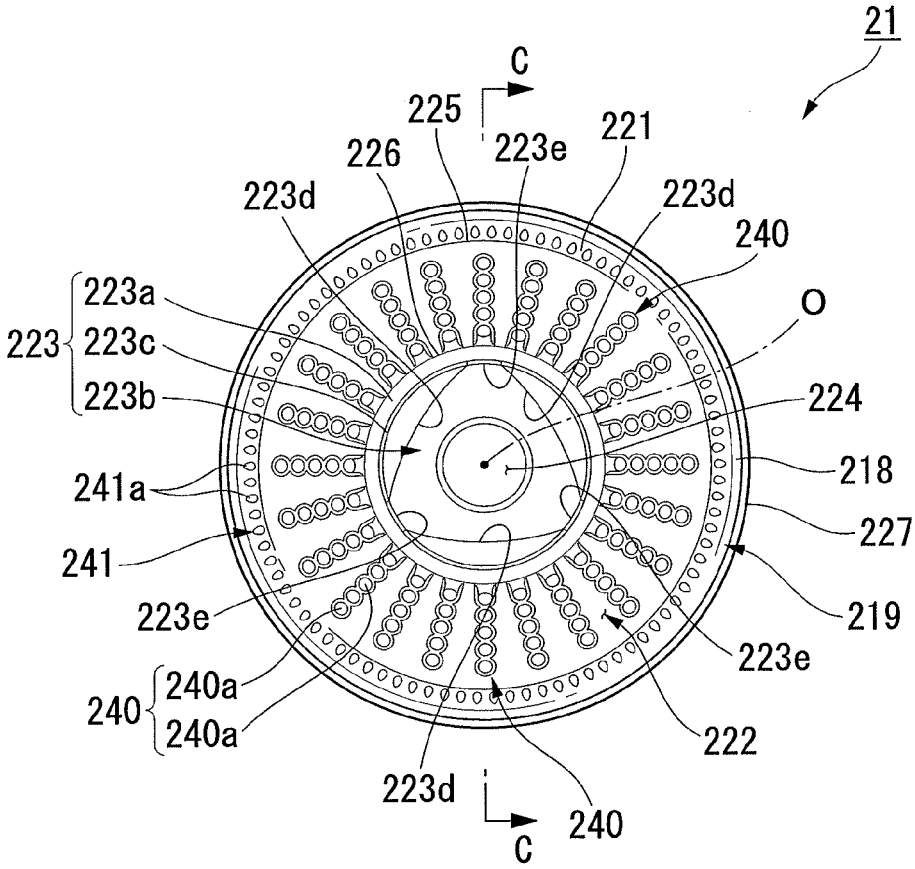
FIG. 7 is a bottom view of a bottle showing a modification according to the embodiment of the present invention.
Figure 8:
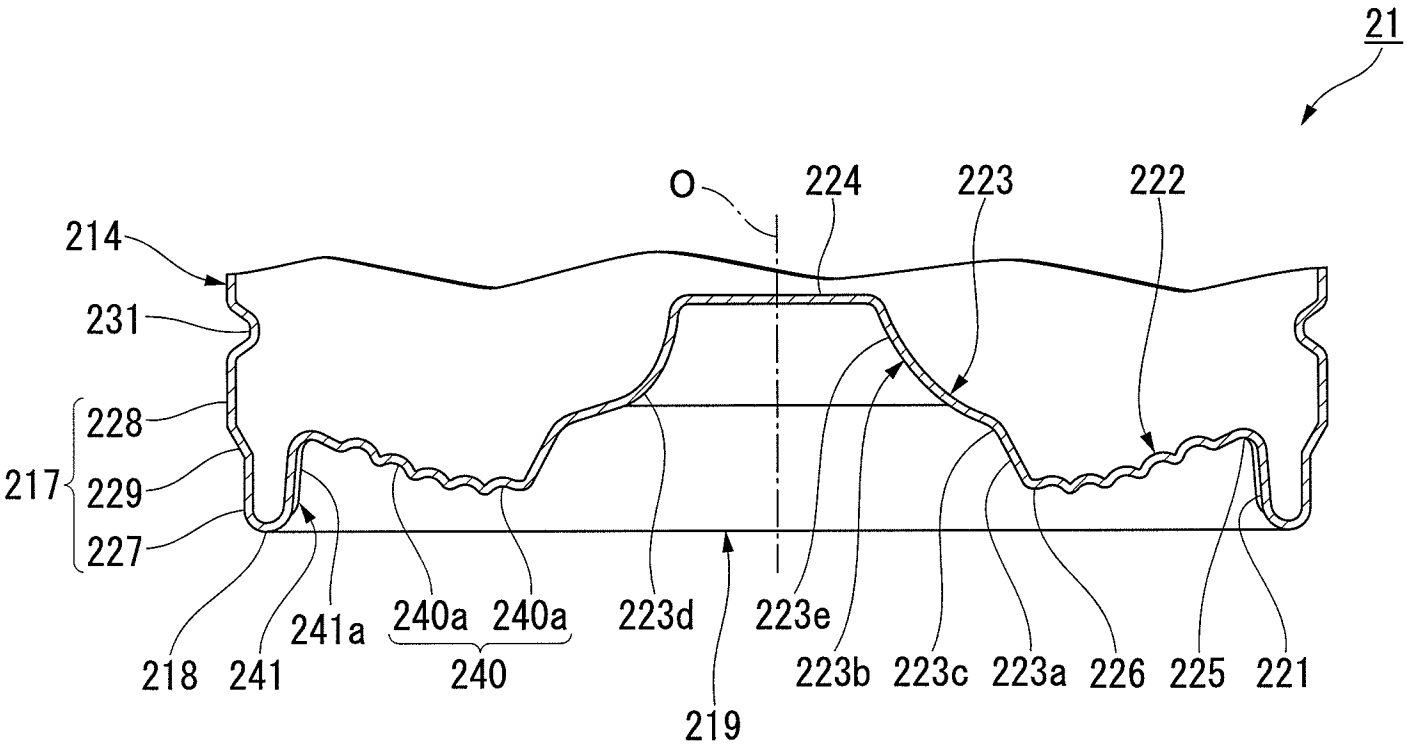
FIG. 8 is a cross-sectional view of the bottle taken along line C-C shown in FIG. 7.

For example, in the second embodiment, as shown in FIGS. 7 and 8, the movable wall portion 222 may have a plurality of ribs 240 radially formed around the bottle axis O. That is, the ribs 240 are disposed at regular intervals in the bottle circumferential direction.

In the examples of FIGS. 7 and 8, the ribs 240 are formed in such a manner that a plurality of recesses 240*a* recessed upward in a curved surface shape extend discontinuously in the bottle radial direction and in a straight line shape. Thereby, the ribs 240 are formed in a waveform when viewed from the longitudinal section following the bottle radial direction. Further, the recesses 240*a* are formed with the same shape and the same size. In other words, the recesses 240*a* are disposed at regular intervals in the bottle radial direction. Thus, in the plurality of ribs 240, positions following the bottle radial direction in which the plurality of recesses 240*a* are disposed are formed equally.

In this way, the plurality of ribs 240 are formed on the movable wall portion 222. Thereby, a surface area of the movable wall portion 222 is increased, and a pressure-receiving area can be increased. As such, the movable wall portion 222 can be deformed in more rapid response to the internal pressure change of the bottle 21.

Furthermore, as shown in FIGS. 7 and 8, an uneven portion 241 may be formed throughout the circumference of the rising circumferential wall portion 221. The uneven portion 241 is constituted in such a manner that a plurality of pimples 241*a* formed in the shape of a curved surface protruding toward the bottle radial inner side are disposed at intervals in the bottle circumferential direction.

In this way, as the uneven portion 241 is formed, a strange feeling when looking at the bottom portion 214 of the bottle 21 filled with the contents, for instance, because light incident on the rising circumferential wall portion 221 is diffusely reflected by the uneven portion 241 or because the contents in the bottle 21 are filled even in the uneven portion 241, is not easily caused.

Further, in the second embodiment, the rising circumferential wall portion 221 may be appropriately modified, for example, may extend in parallel in the direction of the bottle axis O. In addition, the movable wall portion 222 may be appropriately modified, for example, may be formed in the shape of a flat surface or a concave surface recessed upward.

Further, in the second embodiment, the upper tube portion 223*b* is formed in the shape of the curved surface protruding downward, but it is not limited to this shape.

In the second embodiment, the overhang portions 223*d* adjacent to each other in the bottle circumferential direction are disposed at intervals in the bottle circumferential direction, but they are not limited thereto. For example, the overhang portions 223*d* may be disposed in the bottle circumferential direction with no intervals and be directly connected to each other. In this case, a portion of the upper tube portion 223*b* on which the overhang portions 223*d* are disposed may have a circular shape when viewed from the cross section. A shape of the upper tube portion 223*b* when viewed from the cross section may be a circular shape over the whole length of the direction of the bottle axis O.

Further, the overhang portions 223*d* are not essential and may not be provided. Further, the recessed circumferential wall portion 223 is formed in a two-stage tubular shape, but it may be formed in a tubular shape having three stages or more. In addition, the recessed circumferential wall portion 223 may be formed in a multistage shape.

Further, the synthetic resin material forming the bottle 21 may be appropriately modified into, for instance, polyethylene terephthalate, polyethylene naphthalate, amorphous polyester, or a blend material thereof. Furthermore, the bottle 21 is not limited to the single-layer structure, and it may have a laminated structure having an intermediate layer. The intermediate layer includes, for instance, a layer formed of a resin material having a gas barrier characteristic, a layer formed of a recycled material, or a layer formed of a resin material having oxygen absorbability.

Further, in the second embodiment, the shape of each of the shoulder portion 212, the body portion 213, and the bottom portion 214 when viewed from the cross section perpendicular to the bottle axis O is set to the circular shape. However, without being limited thereto, the shape viewed from the cross section may be appropriately modified into, for instance, a polygonal shape.

[Industrial Applicability]

According to the bottle, it is possible to secure the pressure reduction-absorbing performance while suppressing the occurrence of the bottom collapse during filling of contents or raising of internal pressure.

Further, according to the bottle, the performance of absorbing the pressure reduced in the bottle can be improved.

[Reference Signs List]

O: bottle axis

T: height from grounding portion to curved surface part

θ: inclined angle of rising circumferential wall portion

11, 21: bottle

114, 214: bottom portion

118, 218: grounding portion

119, 219: bottom wall portion of bottom portion

121, 221: rising circumferential wall portion

122, 222: movable wall portion

123, 223: recessed circumferential wall portion

125: curved surface part (connection part between movable wall portion and rising circumferential wall portion)

225: curved surface part (outer end of movable wall portion)

226: curved surface part (inner end of movable wall portion)

The invention claimed is:

1. A bottle formed of a synthetic resin material in a cylindrical shape with a bottom, having a bottom wall portion, the bottom wall portion comprising:

a grounding portion located at an outer circumferential edge of the bottom wall portion;

a rising circumferential wall portion that is connected to the grounding portion and that extends upward and inward toward a central longitudinal axis of the bottle;

an annular movable wall portion protruding from an upper end of the rising circumferential wall portion toward the central longitudinal axis of the bottle; and a recessed circumferential wall portion that is connected to the movable wall portion and that extends upward and inward toward the central longitudinal axis of the bottle, wherein:

the movable wall portion is free to rotate around a connecting portion connected to the rising circumferential wall portion so as to move the recessed circumferential wall portion in an upward direction, and the rising circumferential wall portion extends so as to be gradually inclined upward from the grounding portion to the connecting portion, an inclined angle thereof is equal to or less than 10° with respect to the central longitudinal axis of the bottle, and a height from a grounding plane to the connecting portion connected to the rising circumferential wall portion exceeds 7.5 mm

2. The bottle according to claim 1, wherein:

the movable wall portion gradually extends downward from an outer end thereof, which is connected to the rising circumferential wall portion, to an inner end thereof, which is connected to the recessed circumferential wall portion; and a height from the grounding plane to a lowermost end of the movable wall portion has a range between 35% and 65% of a height from the grounding plane to the outer end of the movable wall portion.

3. The bottle according to claim 2, wherein the height from the grounding plane to the lowermost end of the movable wall portion is equal to or greater than 3 mm.

4. The bottle according to claim 1, wherein a lowermost portion of the grounding portion is configured to be tangent to the grounding plane.

5. The bottle according to claim 1, wherein a diameter of the grounding portion is less than or equal to 85 mm.

6. The bottle according to claim 2, wherein the bottle is unfilled.

* * * * *